US006951976B1

(12) United States Patent
Shigenaga

(10) Patent No.: US 6,951,976 B1
(45) Date of Patent: Oct. 4, 2005

(54) HIGH HAT STAND PROMPTLY RESPONSIVE TO PLAYER'S FOOTING

(75) Inventor: Fumihiro Shigenaga, Shizuoka (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/598,544

(22) Filed: Jun. 21, 2000

(30) Foreign Application Priority Data

Jun. 21, 1999 (JP) ..... 11-173898

(51) Int. Cl.[7] ..... G10D 13/02
(52) U.S. Cl. ..... 84/422.3; 84/422.1; 84/422.2
(58) Field of Search ..... 84/422.3, 422.1, 84/422.2; 248/161

(56) References Cited

U.S. PATENT DOCUMENTS 4,898,062 A * 2/1990 Hoshino ..... 84/422.3
4,905,565 A 3/1990 Hoshino
5,192,822 A * 3/1993 Hoshino ..... 84/422.3
6,003,822 A * 12/1999 Kurosaki ..... 248/161

FOREIGN PATENT DOCUMENTS

JP 2-58099 2/1990
JP 2632019 B2 3/1990
JP 2544766 Y2 9/1992

OTHER PUBLICATIONS

English Translation of JP 2544766 (Y2).
Patent Abstracts of Japan, vol. 014, No. 233 (P–1049), May 17, 1990 & JP 02–058099 A (Hoshino Gakki KK), Feb. 27, 1990. (ALSO=USPN 4898062).

* cited by examiner

*Primary Examiner*—Shih-Yung Hsieh
(74) *Attorney, Agent, or Firm*—Dickstein, Shapiro, Morin & Oshinsky, LLP.

(57) ABSTRACT

A high hat stand keeps high hat cymbals straight on a floor, and crashes the top cymbal against the bottom cymbal in response to player's fooling, wherein a toggle joint is connected between an extension rod connected to the top cymbal, a foot board depressed by the player and a stationary frame so as to achieve a large magnification ratio between the force exerted on the foot board and the force exerted on the extension rod, thereby improving the response to the player's footing.

12 Claims, 4 Drawing Sheets

HIGH HAT STAND PROMPTLY RESPONSIVE TO PLAYER'S FOOTING

FIELD OF THE INVENTION

This invention relates to a stand for a musical instrument and, more particularly, to a high hat stand for keeping high hat cymbals over drums.

DESCRIPTION OF THE RELATED ART

The high hat cymbals are a member of the drum set, and a drummer produces brilliant clashing sound through different styles of rendition. The upper movable cymbal and the lower stationary cymbal are called as "top" and "bottom-"respectively. While any external force is not exerted on a foot pedal forming a part of the high hat stand, the high hat stand keeps the high hat cymbals closed. However, when the drummer steps on a foot pedal, the high hat stand upwardly spaces the top cymbal from the bottom cymbal. The drummer removes the external force from the foot pedal. Then, the top cymbal is crashed against the bottom cymbal, and the high hat cymbals produce the sound.

A typical example of the high hat stand is disclosed in Japanese Patent Publication of Unexamined Application No. 2-58099. FIG. 1 illustrates the prior art high hat stand disclosed in the Japanese Patent Publication of Unexamined Application. The prior art high hat stand is broken down into a cymbal sustainer 1, a set of legs 2 and a driver 3. High hat cymbals 4/5 are sustained by the cymbal sustainer 1, and the top cymbal 4 is movable with respect to the bottom cymbal 5. The legs 2 are connected to the cymbal sustainer 1, and keeps the cymbal sustainer 1 and, accordingly, the high hat cymbals 4/5 upright on a floor 6. The driver 3 is connected through the cymbal sustainer 1 to the top cymbals 4, and is responsive to the step of the drummer so as to space the top cymbal 4 from the bottom cymbal 5 and crash the top cymbal 4 against the bottom cymbal 5. Thus, the drummer produces the clashing sound through the driver 3.

The cymbal sustainer 1 includes a guide member 7 and an extension rod 8. The guide member 7 is cylindrical, and is shorter than the extension rod 8. The extension rod 7 is slidably inserted into the guide member 7, and projects from both ends of the guide member 7. The legs 2 are connected to the guide member 7, and keep the guide member 7 upright. The bottom cymbal 5 is fixed to the guide member 7, and, accordingly, is stationary with respect to the floor 6. On the other hand, the top cymbal 4 is fixed to the extension rod 8, and is movable together with the extension rod 8. Thus, the guide member 7 and the extension rod 8 sustain the top cymbal 4 and the bottom cymbal 5 over the floor 6.

The driver 3 includes a frame 10, a linkage 11, a coil spring 12 and a foot pedal 13. The frame 10 is put on the floor 6, and the movable rod 8 passes a hole formed in the frame 10. The coil spring 12 is connected at the upper end thereof to the guide member 7 by means of a bracket 12*a* and at the lower end thereof to the extension rod 8 by means of a retainer ring 12*b*. The coil spring 12 is expanded between the guide member 7 and the extension rod 8, and upwardly urges the extension rod 8. In other words, the coil spring 13 exerts initial force on the extension rod. 8 in the upward direction, and spaces the top cymbal 4 from the bottom cymbal S. While the extension rod 8 is being pulled downwardly, the coil spring 12 is further expanded, and, accordingly, increases the upward force exerted on the extension rod 8.

The foot pedal 13 is broken down into three parts, i.e., a base block 13*a*, a foot board 13*b* and a pin 13*c*. The base block 13*a* is put on the floor 6, and the foot board 13*b* is connected to the base block 13*a* by means of the pin 13*c*. Thus, the foot board 13*b* is turnable with respect to the base block 13*a* around the pin 13*c*.

The linkage 11 is connected between the extension rod 8, the frame 10 and the foot pedal 13. Three links 15/16/17 form in combination the linkage 11. The link 15 is connected at one end thereof to the lower end of the extension rod 8 by means of a hinge 19. The link 16 is connected at one end thereof to the frame 10 by means of a hinge 20 and at the other end thereof to the link 17 by means of a hinge 21. The other end of the link 15 is connected to an intermediate point of the link 16 by means of a hinge 22. The foot board 13*b* is rotatably connected to the other end of the link 17 by means of a hinge 23. The foot board 13*b* converts the force exerted thereon to moment around the pin 13*c*, and the moment is converted to force exerted on the other end of the link 16 by means of the link 17. The force at the other end produces moment around the hinge 20, and the link 15 converts the moment to force exerted on the lower end of the extension rod 8.

When a drummer steps on the foot board 13*b*, the foot board 13*b* is rotated around the pin 13*c* in the counter clockwise direction, and the link 17 gives rise to rotation of the link 16 around the hinge 20 in the clockwise direction. The link 16 serves as a lever, and makes the force downwardly exerted on the extension rod 8 larger than the force exerted on the hinge 21. Thus, the linkage 11 assists the drummer in actuating the extension rod 8 and, accordingly, the top cymbal 4. When the force downwardly exerted on the extension rod 8 exceeds the initial force, the extension rod 8 is downwardly pulled, and makes the top cymbal 4 to be crashed against the bottom cymbal 5. Thus, the driver 3 gives rise to the downward motion of the extension rod 8 when the downward force exceeds the initial force.

A problem is encountered in the prior art high hat stand in the slow response. In detail, while the downward force is being smaller than the initial force, the coil spring 12 keeps the top cymbal 4 in the home position. Although the linkage 11 makes the force to be required on the foot board 13*b* smaller than the initial force, the prior art high hat stand requires the drummer to rapidly exert large force on the foot board 13*b*. After exceeding the initial force, it is necessary for the drummer to continuously increase the force against the force generated by the coil spring 12 until the top cymbal 4 is crashed against the bottom cymbal 5. Thus, there is a lag time between the footing and the rotation of the foot board 13*b*. This results in the slow response to the footing.

Another problem inherent in the prior art high hat stand is the response varied with the state of the coil spring 12. The expansion of the coil spring 12 is the origin of the initial force, and the initial force is proportional to the increase in length of the coil spring 12. If a coil spring is expanded more than the coil spring 12, the coil spring exerts the initial force larger than that of the coil spring 12 on the extension rod 8. Even though the linkage 11 reduces the force to be required on the foot board 13*b*, the force to be required is varied together with the state of the coil spring 12. In other words, the response is variable between the products of the prior art high hat stand. When a drummer is to perform music on the high hat cymbals attached to a product of the prior art high hat stand different from the usual product, he is bothered with the different response.

SUMMARY OF THE INVENTION

It is therefore an important object of the present invention to provide a high hat stand, which exhibits constant prompt response to player's action.

To accomplish the object, the present invention proposes to insert a toggle joint between a foot pedal and an extension rod.

In accordance with one aspect of the present invention, there is provided a high hat stand for keeping high hat cymbals over a surface comprising a cymbal sustaining structure standing on the surface and including a stationary member connected to one of the high hat cymbals and a movable member connected to the other of the high hat cymbals and bidirectionally movable with respect to the stationary member for crashing the other of the high hat cymbals against the aforesaid one of the high hat cymbals, and a driver including a fool pedal moved with a first force exerted thereon by a player, an elastic member connected between the stationary member and the movable member for urging the movable member in a first direction, a frame stationary with respect to the stationary member and a toggle joint connected between the movable member, the frame and the foot pedal and responsive to the first force so as to move the movable member in a second direction opposite to the first direction.

BRIEF DESCRIPTION OF THE DRAWINGS

The features and advantages of the high hat stand will be more clearly understood from the following description taken in conjunction with the accompanying drawings in which.

DESCRIPTION OF THE PREFERRED EMBODIMENT

Figure 1:
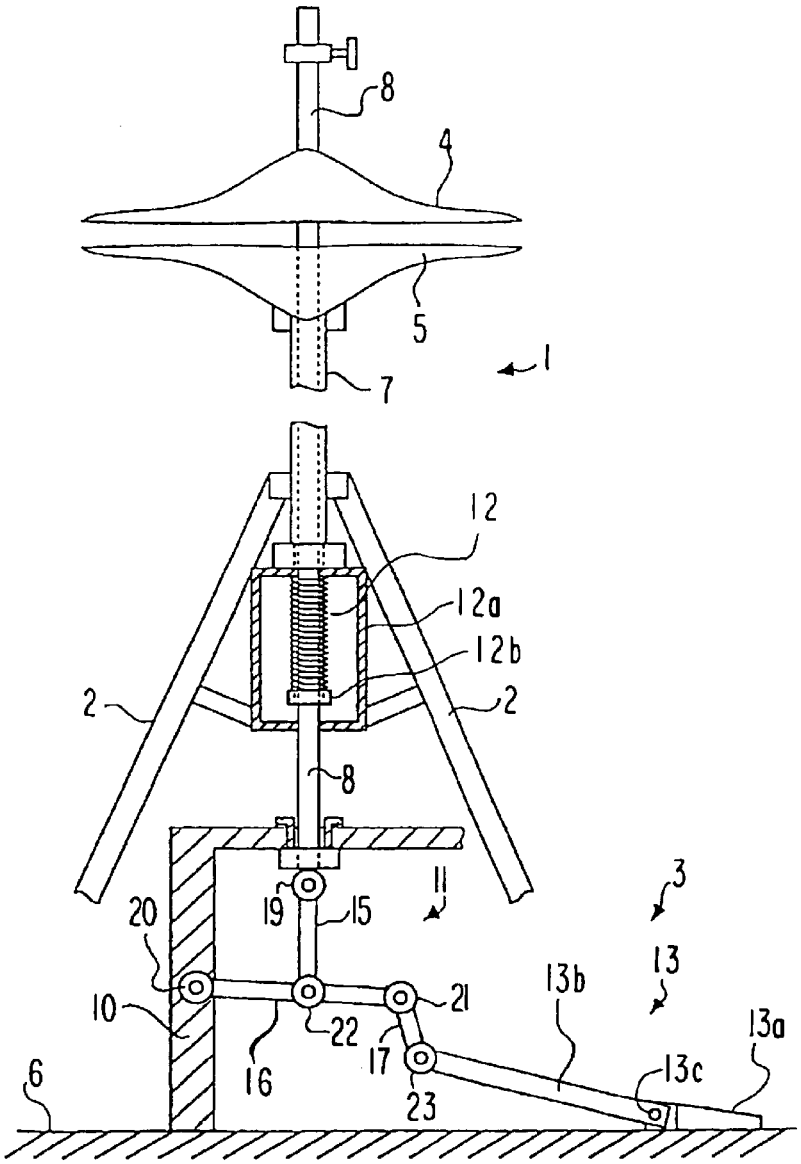
Fig. 1 PRIOR ART
FIG. 1 is a front view showing the prior art high hat stand disclosed in Japanese Patent Publication of Unexamined Application No. 2-58099.
Figure 2:
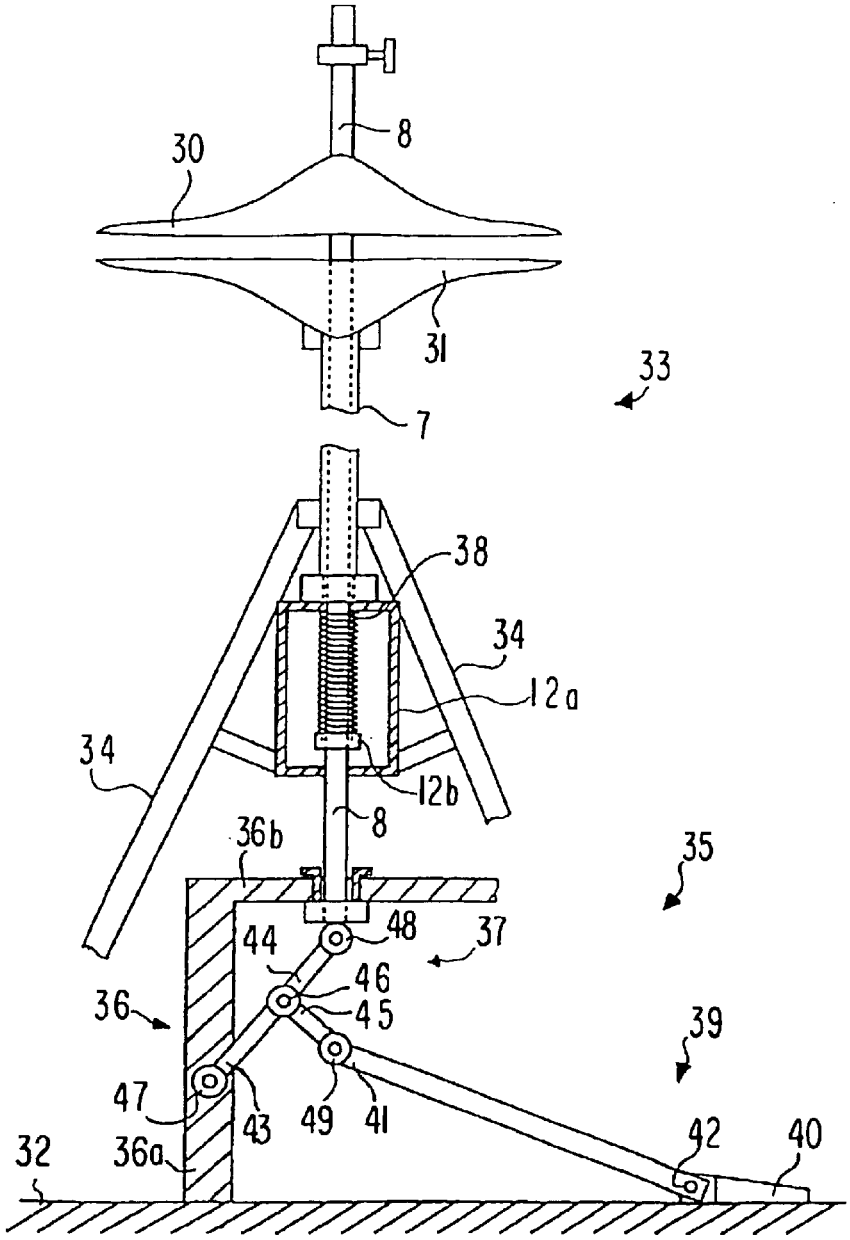
FIG. 2 is a front view showing a high hat stand according to the present invention.

Referring to FIG. 2 of the drawings, a high hat stand embodying the present invention keeps high hat cymbals 30/31 over a floor 32. The high hat stand largely comprises a cymbal sustainer 33, a set of legs 34 and a driver 35 as similar to the prior art high hat stand. The cymbal sustainer 33 and the set of legs 34 are similar to those of the prior art high hat stand. For this reason, parts of the cymbal sustainer 33 are labeled with the same references designating corresponding parts of the cymbal sustainer 1 without detailed description. The cymbal sustainer 33 and the set of legs 34 as a whole constitute a cymbal sustaining structure.

The driver 35 is broken down into a frame 36, a toggle joint 37, a coil spring 38 and a foot pedal 39. The frame 36, the coil spring 38 and the foot pedal 39 are respectively corresponding to the frame 10, the coil spring 12 and the foot pedal 13, and the linkage 11 is replaced with the toggle joint 37. The coil spring 38 is connected at one end thereof to the bracket 12*a* and at the other end thereof to the retainer ring 12*b*, and the bracket 12*a* and the retainer ring 12*b* is fixed to the guide member 7 and the extension rod 8, respectively. The upper end of the bracket 12*a* is spaced from the retainer ring 12*b* by a distance, which is greater than the natural length of the coil spring 38. For this reason, the coil spring 38 is expanded between the guide member 7 and the extension rod 8, and upwardly exerts initial force on the extension rod 8. While a player is remaining the foot pedal 39 free from force, the extension rod 8 upwardly projects due to the initial force, and spaces the top cymbal 30 from the bottom cymbal 31 as shown in FIG. 2. The position where the extension rod 8 projects due to the initial force is hereinbelow referred to as "home position".

The frame 36 is put on the floor 32, and sustains the cymbal sustainer 33 and the high hat cymbals 30/31. In this instance, a pair of side plates 36*a* and an upper plate 36*b* are assembled into the frame 36. Although one of the side plates 36*a* is shown in FIG. 2, another side plate is provided on the opposite side to the side plate 36*a*, and the upper plate 36*b* is bridged between those side plates 36*a*. The side plates 36*a* and the upper plate 36 define an inner space for the toggle joint 37.

The foot pedal 39 includes a base block 40, a foot board 41 and a pin 42. The base block 40 is put on the floor 32, and the foot board 41 is connected to the base block 40 by means of the pin 42. The pin 42 offers an axis of rotation to the foot board 41. The base block 40 is stationary on the floor 32, and the foot board 41 is rotatable around the base block 40.

Three links 43/44/45 and a hinge 46 form in combination the toggle joint 37. The links 43/44/45 are independently rotatable around the hinge 46. The link 43 is connected to the frame 36 by means of a hinge 47, and the link 44 is connected to the lower end of the extension rod 8 by means of another hinge 48. Yet another hinge 49 is connected between the link 45 and the foot board 41. While the coil spring 38 is keeping the extension rod 8 at the home position, the hinges 48/49 are positioned on a virtual line substantially aligned with the center axis of the extension rod 8, and the hinges 46/47/48 keep the link 45 substantially vertical with the links 43/44 aligned with each other. Although the hinge 47 is closer to the floor 32 than the hinge 46 in this instance, the relative relation between the hinges 46/47/48 may be different from the relative relation shown in FIG. 2, and the links 43/44/45 are different in length from those shown in the figure.

Figure 3:
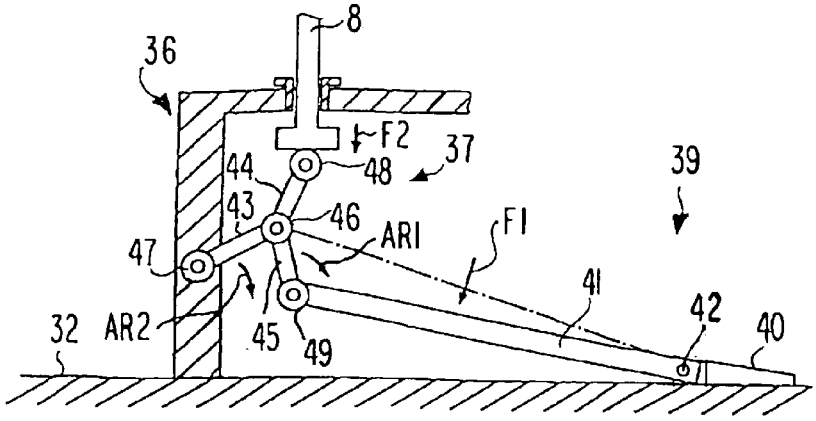
FIG. 3 is a front view showing a toggle joint incorporated in the high hat stand on the way to a crash between high hat cymbals.
Figure 4:
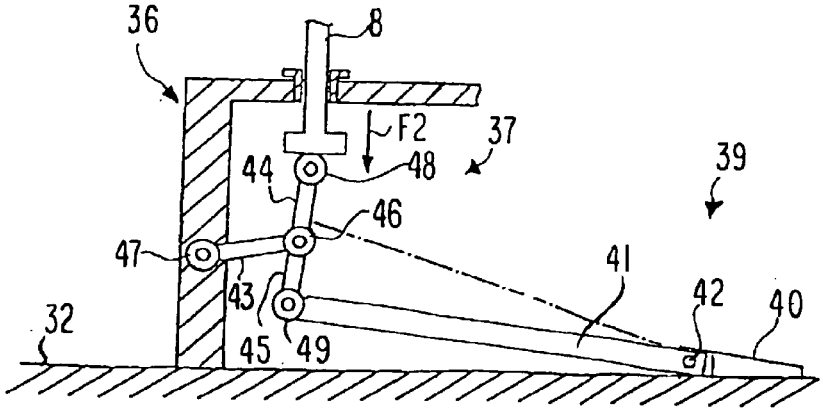
FIG. 4 is a front view showing the toggle joint in the high pat stand further advanced to the crash.

The driver 35 behaves as follows. While a player is depressing the foot board 41, the toggle joint 37 changes the links 43/44/45 from the relative relation shown in FIG. 2 through the relative relation shown in FIG. 3 to the relative relation shown in FIG. 4. The links 44/45 become on the straight.

In detail, the player exerts force F1 on the foot board 41 at the initial position shown in FIG. 2. The force F1 gives rise to rotation of the foot pedal 41 in the counter clockwise direction around the pin 42, and causes the toggle joint 37 to vary the relative relation between the links 43/44/45. The link 45 is rotated around the hinge 46 in the direction indicated by arrow AR1, and the link 43 is rotated around the hinge 47 in the direction indicated by arrow AR2. The link 44 is rotated around the hinge 48 in the counter clockwise direction, and downwardly exerts force F2 on the extension rod 8. This results in the downward motion of the extension rod 8.

The player is assumed to continuously depress the foot board 41. The links 43/44/45 continue the rotation, and reaches the relative relation shown in FIG. 4.

When the player removes the force F1 from the fool board 41, the coil spring 38 upwardly pulls the extension rod 8, and the extension rod 8 returns to the home position. The links 43/44/45 are rotated in the opposite directions, and are recovered to the relative relation shown in FIG. 2.

Figure 5:
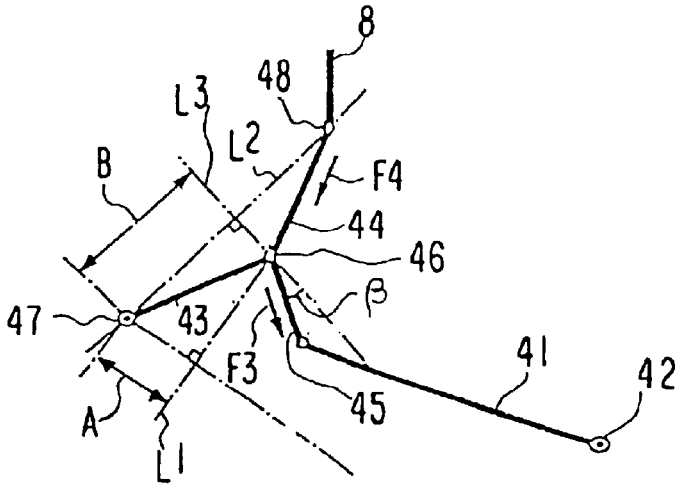
FIG. 5 is a diagram showing the motion of the toggle joint.

The links 43/44/45 are assumed to pass the relative relation shown in FIG. 5 during the rotation of the foot board 41 around the pin 42. Line L1 is an extension line of the center axis of the link 44, and line L2 passes through the hinges 47/48. Line L3 is vertical to line L2, and passes through the hinge 46. A vertical line is drawn from the hinge 47 to the line L1, and A stands for the length between the hinge 47 and the intersecting point. Another vertical line is drawn from the hinge 46 to the line L2, and B stands for the length between the intersecting point and the hinge 47. The center axis of the link 45 intersects an extension line of the vertical line from the hinge 46 at angle β.

The player is assumed to exert the force F1 on the foot board 41. The foot board 41 pulls the link 45, only, and force F3 is exerted on the link 45 in the direction of the center axis thereof. The link 45 further pulls the links 43 and 44, and force F4 is exerted on the link 44 in the direction of the center axis thereof. Finally, the link 44 pulls the extension rod 8 with the vertical component force of F4. Thus, the relation between the force F3 and the force F4 represents the force F1 exerted on the foot board 41 and the force F2 exerted on the extension rod 8. The relation between the force F3 and the force F4 is expressed as $$F3=K\times F4 \qquad \text{Equation 1}$$

$$K=A/(B\times\cos\beta) \qquad \text{Equation 2}$$

Figure 6:
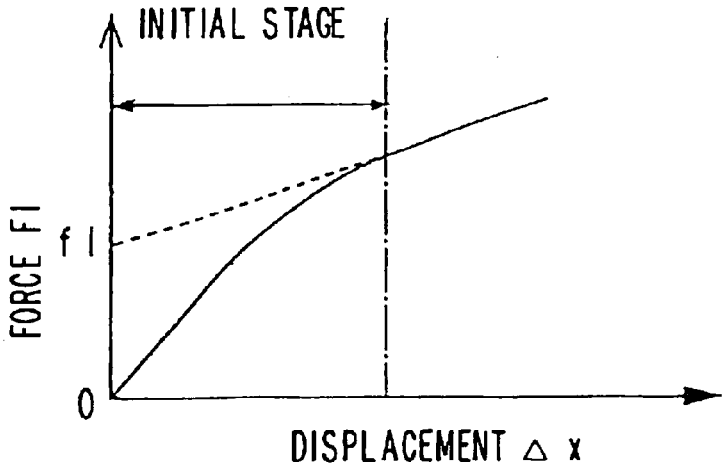
FIG. 6 is a graph showing relation between the stroke of a foot board and force exerted on an extension rod.

When the extension rod 8 is at the home position, the links 43/44 are on the straight, and the link 45 is vertical to the links 43/44. Thus, the angles is zero, and the length A is zero at the home position. The angles β and the length A are increased together with the rotation of the foot board 41. From equations 1 and 2, the force F4 is equal to the product of F3×(1/K). This means that the toggle joint 37 magnifies the force F3 at ratio (B cos β/A). The ratio (B cos β/A) is much greater than 1 immediately after the player starts the footing, and the force F2 exceeds the initial force. As a result, the displacement Δx of the extension rod is increased together with the force F1 as indicated by real line in FIG. 6. When the toggle joint 37 reaches the relation shown in FIG. 4, the displacement Δx is linearly increased together with the force F1. Even if the initial force is large, the toggle joint 37 promptly responds to the player's footing, because the ratio (B cos β/A) is large enough to drive the extension rod 8 with relatively small force. The large initial force causes the extension rod 8 and, accordingly, the top cymbal 30 to return to the home position, and the player produces fast beat through the high hat cymbals 30/31 on the high hat stand according to the present invention.

Broken line stands for the relation between the displacement of the extension rod 8 and the force exerted on the fool board 13*b* of the prior art high hat stand. Although the linkage 11 magnifies the force exerted on the foot board 13*b*, the magnification ratio is constant and not large. For this reason, the extension rod 8 is not moved until the force exceeds the value f1 of the initial force. Comparing the real line with broken line, it is understandable that the driver 35 promptly responds the player's footing.

Although a particular embodiment of the present invention has been shown and described, it will be apparent to those skilled in the art that various changes and modifications may be made without departing from the spirit and scope of the present invention.

For example, even if the links 43/44 are not on the straight, the toggle joint achieves the prompt response in so far as the magnification ratio causes the force F2 to immediately exceed the initial force of the coil spring 33.

The toggle joint enhances the response of the driver in so far as the magnification ratio in the initial stage is larger than the magnification ratio of the linkage 11. When the toggle joint achieves the magnification ratio larger than that of the prior art linkage 11 over the rotation of the foot board 11 in the angular range, the player feels the response improved.

What is claimed is:

1. A high hat stand for keeping high hat cymbals over a surface, comprising:

a cymbal sustaining structure standing on said surface, and including a stationary member connected to one of said high hat cymbals and a movable member connected to the other of said high hat cymbals and bidirectionally movable with respect to said stationary member for crashing said other of said high hat cymbals against said one of said high hat cymbals; and a driver including a foot pedal moved with a first force exerted thereon by a player, an elastic member connected between said stationary member and said movable member for urging said movable member in a first direction, a frame stationary with respect to said stationary member, and a toggle joint connected between said movable member, said frame and said foot pedal and responsive to said first force so as to move said movable member in a second direction opposite to said first direction.

2. The high hat stand as set forth in claim 1, in which said stationary member has a cylindrical configuration, and said movable member is inserted into an inner space of said stationary member in such a manner that both end portions of said movable member project from both ends of said stationary member.

3. The high hat stand as set forth in claim 2, in which said cymbal sustaining structure further includes a set of legs connected to said stationary member so as to keep said stationary member and said movable member upright over said surface.

4. The high hat stand as set forth in claim 1, in which said foot pedal includes a base block placed on said surface, and a foot board rotatably connected between said base block and said toggle joint.

5. The high hat stand as set forth in claim 1, in which said toggle joint is structured and arranged to achieve a magnification ratio of said second force to said first force so as to move said movable member in said second direction in an initial stage of the motion of said foot pedal.

6. A hat stand for keeping high hat cymbals over a surface, comprising:

a cymbal sustaining structure standing on said surface, and including a stationary member connected to one of said high hat cymbals and a movable member connected to the other of said high hat cymbals and bidirectionally movable with respect to said stationary member for crashing said other of said high hat cymbals against said one of said high hat cymbals; and a driver including a foot pedal moved with a first force exerted thereon by a player, an elastic member connected between said stationary member and said movable member for urging said movable member in a first direction, a frame stationary with respect to said stationary member, and a toggle joint connected between said movable member, said frame and said foot pedal and responsive to said first force so as to move said movable member in a second direction opposite to said first direction, said toggle joint including a first link rotatably connected at one end thereof to said frame, a second link rotatably connected at one end thereof to the other end of said first link and at the other end thereof to said movable member, and a third link rotatable connected at one end thereof to said foot pedal and at the other end thereof to said other end of said first link and said one end of said second link so as to exert a second force on said movable member.

7. The high hat stand as set forth in claim 6, in which the connection between said second link and said movable member is higher than the connection between said first link and said frame with respect to said surface.

8. The high hat stand as set forth in claim 7, in which said third link obliquely extends from said connection between said first link and said second link toward said foot pedal lower than said connection between said second link and said movable member with respect to said surface.

9. The high hat stand as set forth in claim 8, in which said first and second links are arranged on the straight when said first force is zero, and said third link is vertical to said first and second links when said first force is zero.

10. A hat stand for keeping high hat cymbals over a surface, comprising:

a cymbal sustaining structure standing on said surface, and including a stationary member connected to one of said high hat cymbals and a movable member connected to the other of said high hat cymbals and bidirectionally movable with respect to said stationary member for crashing said other of said high hat cymbals against said one of said high hat cymbals;

a driver including a foot pedal moved with a first force exerted thereon by a player, an elastic member connected between said stationary member and said movable member for urging said movable member in a first direction, a frame stationary with respect to said stationary member, and a toggle joint connected between said movable member, said frame and said foot pedal and responsive to said first force so as to move said movable member in a second direction opposite to said first direction, said toggle joint including a first link rotatably connected at one end thereof to said frame, a second link rotatably connected at one end thereof to the other end of said first link and at the other end thereof to said movable member, and a third link rotatable connected at one end thereof to said foot pedal and at the other end thereof to said other end of said first link and said one end of said second link so as to exert a second force on said movable member;

a base block placed on said surface; and a foot board rotatably connected between said base block and said toggle joint.

11. The high hat stand as set forth in claim 10, in which the connection between said second link and said movable member is higher than the connection between said first link and said frame with respect to said surface, and said third link obliquely extends from said connection between said first link and said second link toward said foot board.

12. The high hat stand as set forth in claim 11, in which said first and second links are arranged on the straight when said first force is zero, and said third link is vertical to said first and second links when said first force is zero.

* * * * *